US005248255A

United States Patent [19]

Morioka et al.

[11] Patent Number: 5,248,255

[45] Date of Patent: Sep. 28, 1993

[54] CONTINUOUS KILN

[75] Inventors: Toshimichi Morioka; Yaushisa Hirano; Akira Iwahashi, all of Tokoname; Masataka Matsuo, Kitakyushu; Kazuyoshi Kurayoshi, Kitakyushu; Akio Ishii, Kitakyushu, all of Japan

[73] Assignee: Inax Corporation, Aichi, Japan

[21] Appl. No.: 768,889

[22] PCT Filed: Feb. 28, 1991

[86] PCT No.: PCT/JP91/00263

§ 371 Date: Jun. 8, 1992

§ 102(e) Date: Jun. 8, 1992

[87] PCT Pub. No.: WO91/13307

PCT Pub. Date: Sep. 5, 1991

[30] Foreign Application Priority Data

Mar. 2, 1990 [JP] Japan ..... 2-52373

[51] Int. Cl.[5] ..... F27B 9/20; F27D 3/04

[52] U.S. Cl. ..... 432/127; 432/234; 432/236; 432/128; 431/326

[58] Field of Search ..... 432/234, 236, 124, 126, 432/127, 147, 154, 128; 431/326

[56] References Cited

U.S. PATENT DOCUMENTS

| | | | |
|---|---|---|---|
| 3,100,811 | 8/1963 | Bloom | 432/127 |
| 3,540,705 | 11/1970 | Hoffman | 432/236 |
| 4,504,218 | 3/1985 | Mihara et al. | 131/326 |
| 4,838,241 | 6/1989 | Rieger | 431/326 |
| 4,932,864 | 6/1990 | Miyabe | 432/236 |
| 4,936,771 | 6/1990 | Sidwell | 432/234 |
| 5,088,919 | 2/1992 | DeBrayne et al. | 431/326 |

FOREIGN PATENT DOCUMENTS 62279999 5/1989 Japan .

*Primary Examiner*—Henry C. Yuen

*Attorney, Agent, or Firm*—Kanesaka and Takeuchi

[57] ABSTRACT

The present invention enables a tile or other ceramic wares to have a deep reduced color. A roller hurse kiln 210 includes rollers 214, and a burner mounted in a firing zone adjacent to the outlet so as to provide a reducing gas. The burner has gas injection holes. The injection holes may be circular holes having a diameter of 1 to 5 mm or may be in the form of a slit having a width of 1 to 5 mm. The burner is located 15 to 80 mm above a material to be fired.

17 Claims, 12 Drawing Sheets

CONTINUOUS KILN

TECHNICAL FIELD

This invention relates to a continuous kiln desinged to continuously fire materials to provide tile or other ceramic products.

This invention also relates to a burner adapted to reduce the surface of a material as fired.

BACKGROUND ART

A tile or other ceramic products are obtained by firing materials in a kiln with or without glaze.

The products thus obtained may vary in color depending on atmosphere in which the materials are fired. A tasteful color and appearance may from time to time be obtained when the materials are fired, particularly in a reducing atmosphere.

To this end, a reducing atmosphere is conventionally created in a kiln to simultaneously fire and reduce materials.

Japanese patent publication No. 17797/90 discloses a continuous kiln which includes a preheating zone, a firing zone and a cooling zone. Materials are continuously conveyed through the kiln. A reducing burner is mounted so as to apply a reducing flame directly to the material during a reducing operation, rather than a firing operation.

A roller hurse kiln, as a continuous kiln, includes a tunnel furnace, a number of rollers by which a material to be fired is conveyed through the furnace, a burner mounted to the furnace, and a fan assembly. Each horizontal roller has an axis extending at right angles to the longitudinal direction of the furnace and is rotated by a motor. The rollers are spaced for a short distance away from one another. Materials to be fired are continuously conveyed on the rollers. The furnace has a preheating zone at its inlet, a firing zone at its center, and a cooling zone extending from the center to its outlet.

In the continuous kiln of Japanese patent publication No. 17797/90, a flame is applied from the reducing burner directly to materials during a reducing operation rather than a firing operation. An external gas is excluded to maintain a reducing atmosphere. This results in uniform reduction of the materials as conveyed continuously through the furnace to continuously provide products of equal color and constant quality on a mass production basis.

A reducing atmosphere is produced generally by maintaining an air-to-fuel ratio for the firing burner below its normal ratio. However, it is difficult to maintain and control reducing conditions under such a reducing atmosphere for the reasons as will later be explained.

Reduction is to remove oxygen from a material as fired. When fuel in gas phase (for example, propane gas) including carbon and hydrogen is used, a mixture of carbon monoxide and hydrogen, produced as a decomposition by a burner flame, is used as a reducing gas to reduce the material. Carbon monoxide contains a substantial amount of carbon and is stable at a high temperature or above 1200° C. Carbon monoxide is however not stable at a temperature below 1200° C. If oxygen is contained slightly more than it should be, carbon monoxide is decomposed to carbon and carbon dioxide as a result of carbon deposition reaction as its temperature decreases.

When a material is reduced under a reducing atmosphere, it is difficult to completely eliminate external atmosphere such as those in the preceding and following operations. It is difficult to maintain an atmosphere suitable for reducing a material.

The temperature of a material during a reducing operation is also an important factor. It is extremely difficult to uniformly reduce materials under such an atmosphere while adjusting the temperature of the materials. A conventional method for reducing materials as fired is unable to constantly provide products of a desired reduced color.

DISCLOSURE OF THE INVENTION

Accordingly, the present invention employees an improved reducing burner in a continuous kiln wherein a reducing flame is applied directly to materials while the materials are continuously conveyed. A reducing flame is applied at a constant flow rate to shield the materials from an external atmosphere. This better reduces the surface of each material.

In order to effectively reduce a material by a burner, attempts should be made to increase the production rate and the applicability of reducing gases.

The burner employs, as a fuel in gas phase, propane gas, acetylene or the like which includes carbon and hydrogen. The fuel is combusted under the existence of air (oxygen) to produce a flame. The flame is used to decompose the residual fuel to provide reducing gases such as carbon monoxide and hydrogen. The gas receives resistance at its outer peripheral portion by the inner wall of an injection pipe as well as an external air after the gas is injected from the injection hole. As a result, the gas flows faster at its central portion than at its outer peripheral portion.

Since the fuel is combusted at a constant rate, the flame may enter into the injection hole if the flow rate of the outer peripheral portion of the gas is less than a given level. To prevent this, it is necessary to inject fuel from the injection hole at a speed faster than a given speed. In this case, the flow rate of the central portion of the gas is faster than an appropriate speed, and flame or reducing gases are produced at a place spaced quite a distance away from the injection hole. Thus, the gas differs in composition and density between its outer peripheral portion and its central portion. Additionally, since the gas is injected at a faster rate, turbulence may occur in the flame and reducing gases. This results in a change in reducing conditions.

A flame is produced from the central portion of the gas at a place spaced away from the injection hole. The injection hole should thus be space at a considerable distance away from a material as fired during a reducing operation. This allows an external air to enter into a portion of the material where reduction is effected. This also results in a change in reducing conditions and makes it difficult to control such reduction conditions.

The burner as used in the present invention is a reducing burner adapted to produce reducing gases from fuel so as to apply the reducing gases directly to the surface of a material during a reducing operation. A number of injection holes are accurately arranged in the burner and have a diameter of 1 to 5 mm. The distance between adjacent injection holes is less than three times of the diameter of the injection hole.

With such small injection holes, the outer peripheral portion and the central portion of the fuel are injected from the injection holes at a substantially equal speed.

Thus, the the outer peripheral portion and the central portion of the fuel are equally combusted and become identical in composition and density.

Additionally, the fuel can be injected generally at a slower speed. This allows the fuel, not only its outer peripheral portion, but also its central portion, to be combusted immediately after it is injected so as to immediately produce reducing gases. The injection holes can thus be located closer to the surface of a material as fired during a reducing operation. This minimizes the effect of an external air and makes it possible to reduce the surface of the material under equal conditions.

The reducing gases are applied to reduce the surface of the material typically within a short period of time. To this end, the burner of the present invention has a number of arrays of injection holes extending at right angles to the direction of conveyance of the materials. The reducing gases are applied while the materials are conveyed below the burner.

A burner according to another embodiment of the present invention is a reducing burner adapted to produce reducing gases from fuel so as to apply the reducing gases directly to the surface of each material as fired. At least some of injection holes of the burner are in the form of a slit having a width of 1 to 5 mm.

These elongate injection holes or slits of the burner provide the same advantages as those of the injection holes accurately arranged and having a small diameter as explained earlier.

Alternatively, some of the injection holes may be in the form of a slit, and the other injection holes may be small circular holes. In either case, the distance between adjacent injection holes in the direction of the burner should be less than three times of the width of each injection hole or slit.

The burner may include a premixing chamber to mix the fuel with a gas (or inert gas) to promote combustion before the fuel is supplied to the injection holes.

By this arrangement, the fuel and gas are well mixed before they are injected from the injection holes. This results in immediate production of reducing gases of uniform composition.

The burner may also include a shielding wall which extends from the edge of a injection surface to wrap flame so as to shield it from an external atmosphere. In this way, reducing gases can be applied to a material inside of the shielding wall.

This advantageously treats the material by reduction process.

The continuous kiln with the burner better eliminates an external atmosphere and controls reducing conditions to provide a uniform reduced color. Also, a plurality of reduced color may easily be obtained by changing reducing conditions, for example, by selectively operating the injection holes or by changing the density of reducing gases and the temperature of a flame.

In the present invention, the burner is located adjacent to a material to be fired, preferably 15 to 80 mm, to directly apply reducing flame to the material as fired.

When the burner is spaced more than 80 mm away from the material, then the flame flows at a slower rate. As a result, an external air may enter into the flame. This deteriorates reduction of the material and thus, fails to provide an undesirable reduced color. On the other hand, when the burner is located 15 mm or closer to the material, a sufficient amount of reducing gas can not be obtained. This reduces the effectiveness of reduction and fails to provide a desirable color. Thus, the burner of the present invention should not be too close to or too far away from the material as fired. Otherwise, the material can not properly be treated during a reducing operation. Preferably, the burner is located so that the distance between the base end of the flame and the surface of the material is three tenth to seven tenth of the entire length of the reducing flame, although it may vary depending on the diameter of the burner or combustion conditions.

It is preferable to provide a low reactive gas zone so as to prevent an external gas from entering into a portion of the material where reducing gases are applied from the injection holes during a reducing operation. Low reactive gases include He, Ne and Ar and hardly react to other gases or are chemically innert. $N_2$ or $CO_2$ may also be used.

The low reactive gas zone prevents an external gas from entering into a portion where reduction takes place. A material as fired can thus be treated by reduction process without disturbance of an external atmosphere. That is, reducing conditions can constantly be maintained or controlled to provide a stable reduced color.

The low reactive gas zone can be produced, for example, by injecting a low reactive gas so as to surround reducing gases, in the case that the reducing gases are applied from suitable injection holes to reduce the surface of each material as fired while the materials are continuously conveyed through the furnace. Also, when the width of reducing gases flowing in a direction perpendicular to the direction of conveyance of a material as fired is substantially greater than that of the material, the low reactive gas zone are produced both forwardly and rearwardly or only forwardly of reducing gas flow. If the material as fired can be reduced substantially simultaneously when reducing gases are applied, it is sufficient to produce the low reactive gas zone only forwardly of the reducing gas flow to reduce the material without influence of an external atmosphere.

The low reactive gas zone is in the form of a curtain. Alternatively, the lower reactive gas zone may be formed in a predetermined space to apply reducing gases to reduce materials. The low reactive gas zone may take any other form. The lower gas is preferably preheated by exhaust gases from the furnace, or in the preheating and cooling zones or by any other means.

preferably, a shielding boy is located adjacent to the rollers so as to prevent the reducing flame from passing between the rollers when the reducing flame is applied from the reducing burner directly to a material just fired in the firing zone during a reducing operation.

This prevents the reducing flame from being largely flared whenever the material such as a tile passes through the reducing flame. The surface of the material can thus be reduced under stable conditions to provide a desired reduced color.

BEST MODE FOR CARRYING OUT THE INVENTION

Figure 16:
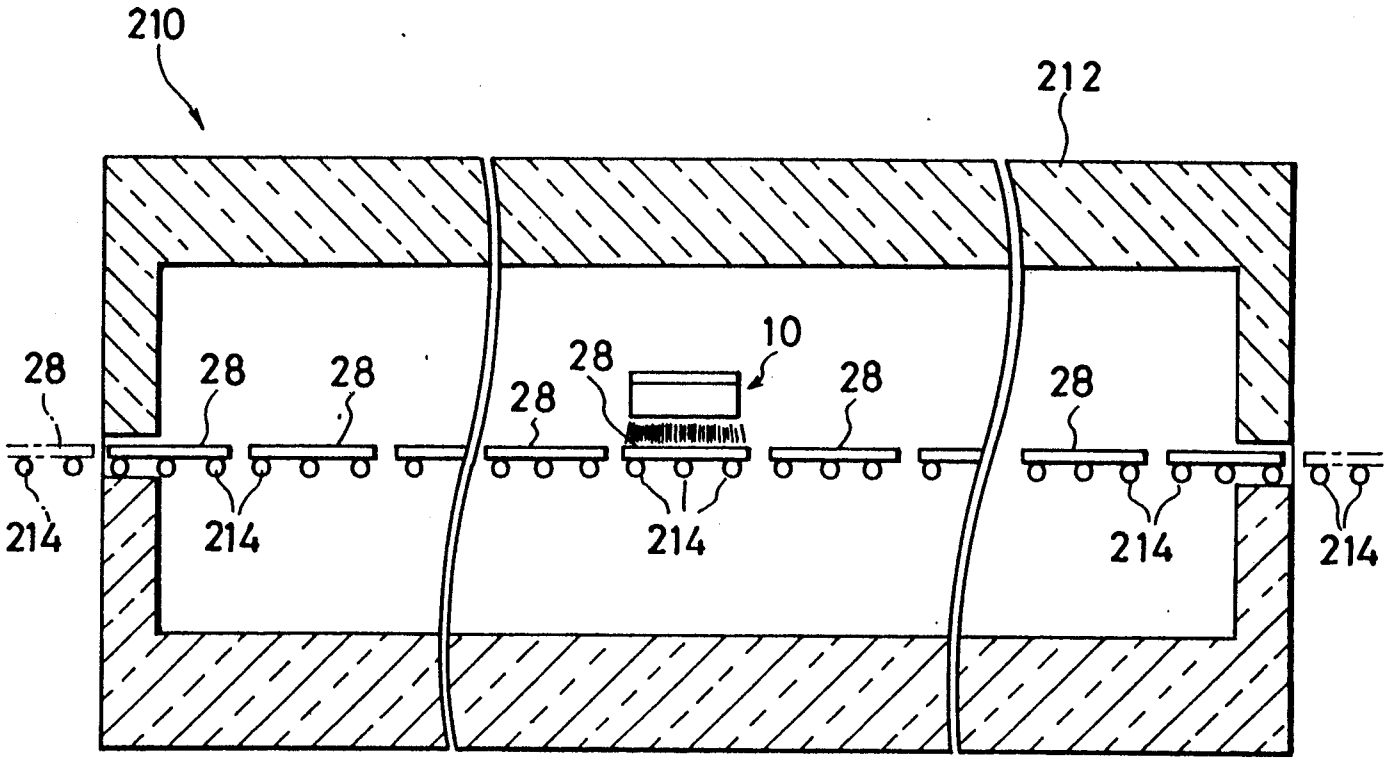
FIG. 16 is a longitudinal sectional view of a roller hurse kiln.
Figure 17:
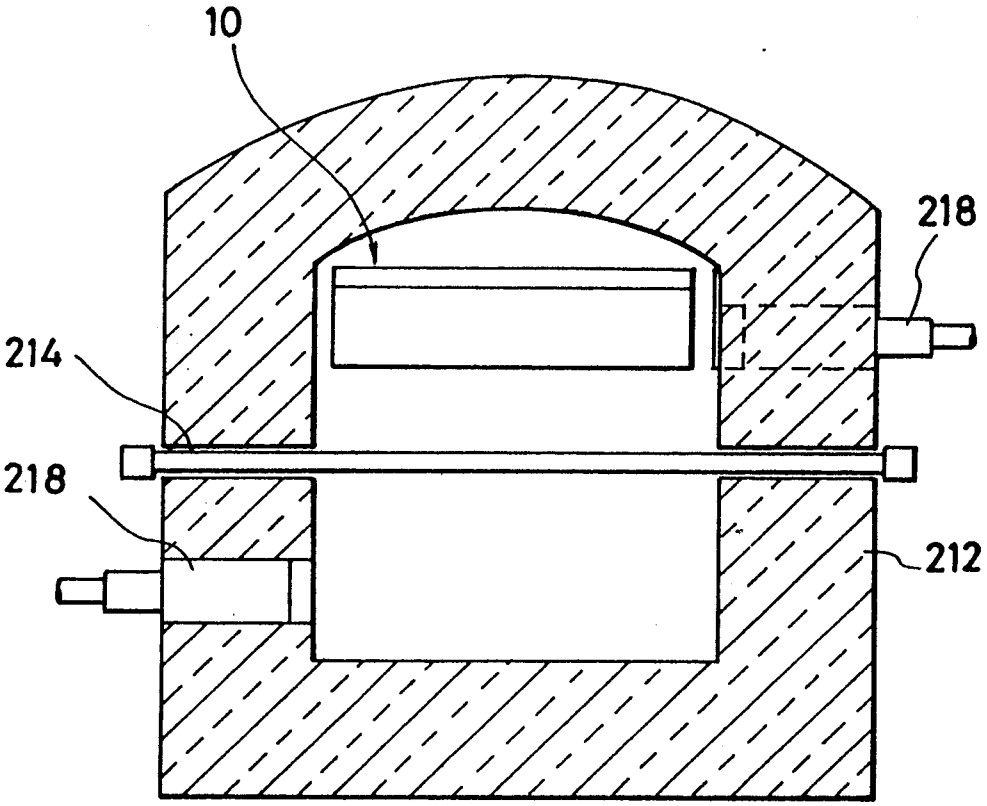
FIG. 17 is a transverse sectional view of the roller hurse kiln.

FIGS. 16 and 17 show the basic structure of a roller hurse kiln as a continuous kiln. In the embodiment, as shown, a roller hurse kiln (hereinafter simply referred to as a kiln) 210 includes a tunnel furnace 212 made from a refractory material, and a number of rollers 214 arranged sequentially throughout the furnace 212 and rotated to convey materials 28 from the inlet to the outlet of the furnace.

The furnace 210 has an intermediate firing zone. A plurality of burners 218 are mounted to the side wall of the firing zone to heat the interior of the furnace. Also, a reducing burner 10 is mounted to the top wall of the furnace to extend downwardly to reduce the materials 28. A reducing flame is applied from the reducing burner 10 directly to the materials 28 so as to reduce the materials 28.

Figure 2:
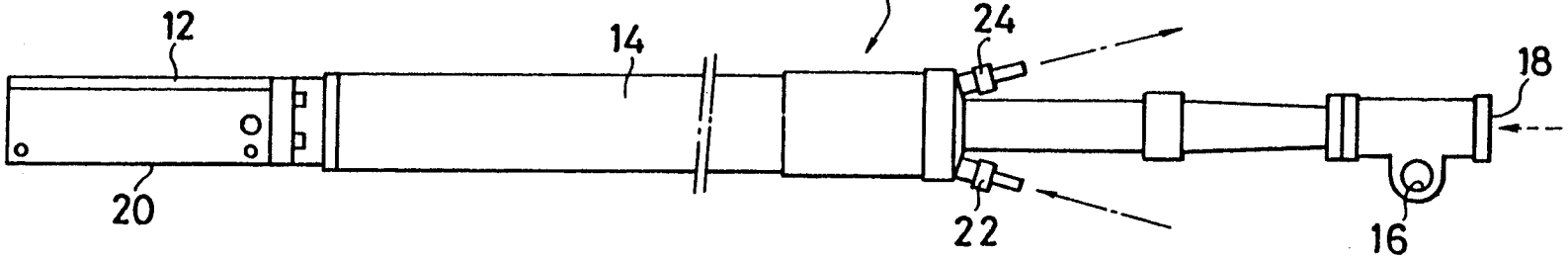
FIGS. 2 and 3 are side and bottom views of the reducing burner, respectively.
Figure 3:
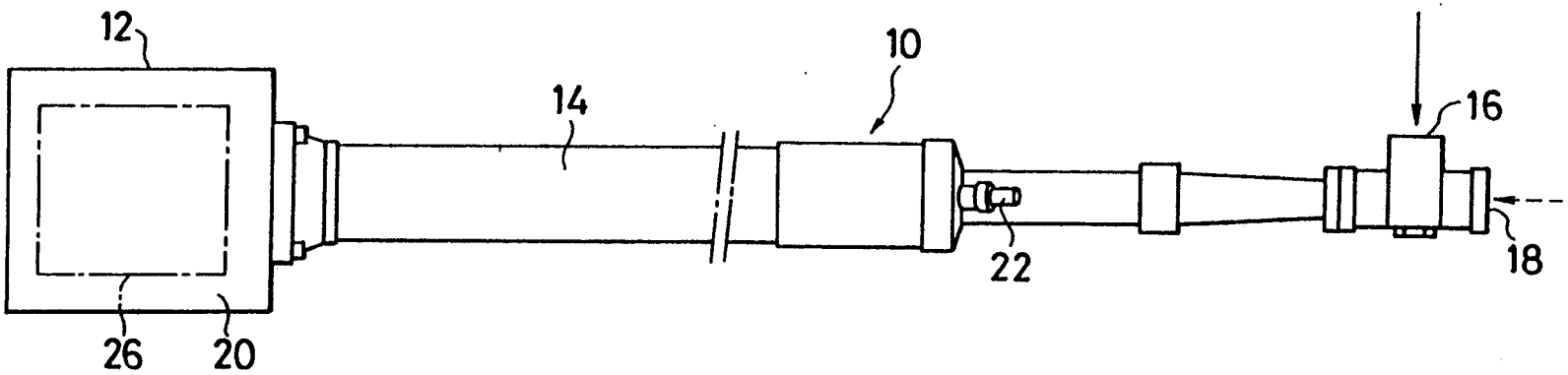
Figure 10:
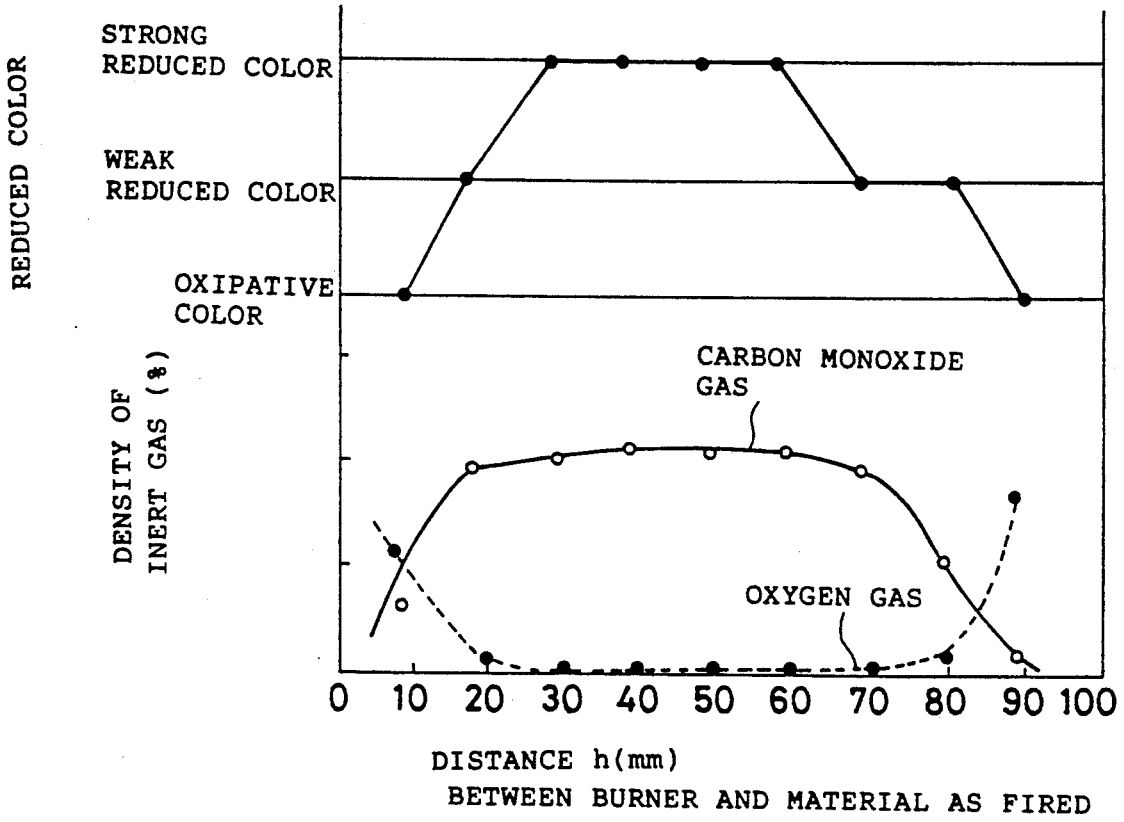
FIG. 10 is a graph showing the results of tests carried out according to the reduction method shown in FIG. 9.

In FIGS. 2 and 3, 10 is a reducing burner made according to one embodiment of the present invention and including a burner head 12, and a premixing chamber 14 adapted to receive fuel in gas phase and air from ports 16 and 18 so as to Provide a mixture of fuel and air to the burner head 12. The burner head 12 has a lower or injection surface 20 through which the mixture is injected for combustion. The residual fuel is decomposed under the influence of flame to provide a reducing gas. In FIG. 2, 22 and 24 are inlet and outlet ports through which cooling water flows.

Figure 4:
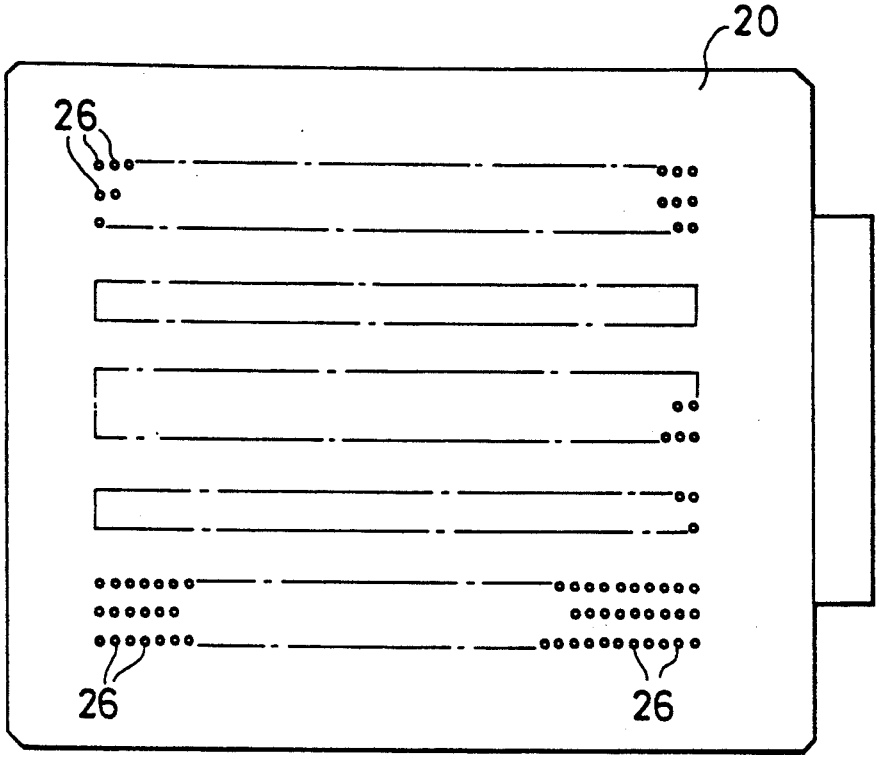
FIG. 4 is a bottom view showing the principal part of the reducing burner.

As shown better in FIG. 4, the injection surface 20 has a number of injection holes 26 through which the mixture is injected for combustion.

Figure 5:
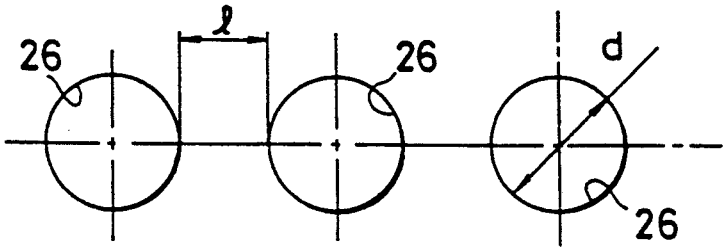
FIG. 5 is a detailed view showing the shape and arrangement of injection holes shown in FIG. 4.

In the embodiment shown in FIG. 5, the injection holes 26 are circular in shape and have a small diameter d of 1 to 5 mm. The injection holes 26 are arranged such that the distance λ between two adjacent injection holes 26 in the longitudinal direction of the injection surface in FIG. 4 is less than three times of the diameter d of each injection hole. This arrangement enables each injection hole 26 to provide its own flame. Thus, the density of flames may differ, and an external air may enter into the flames.

Figure 1:
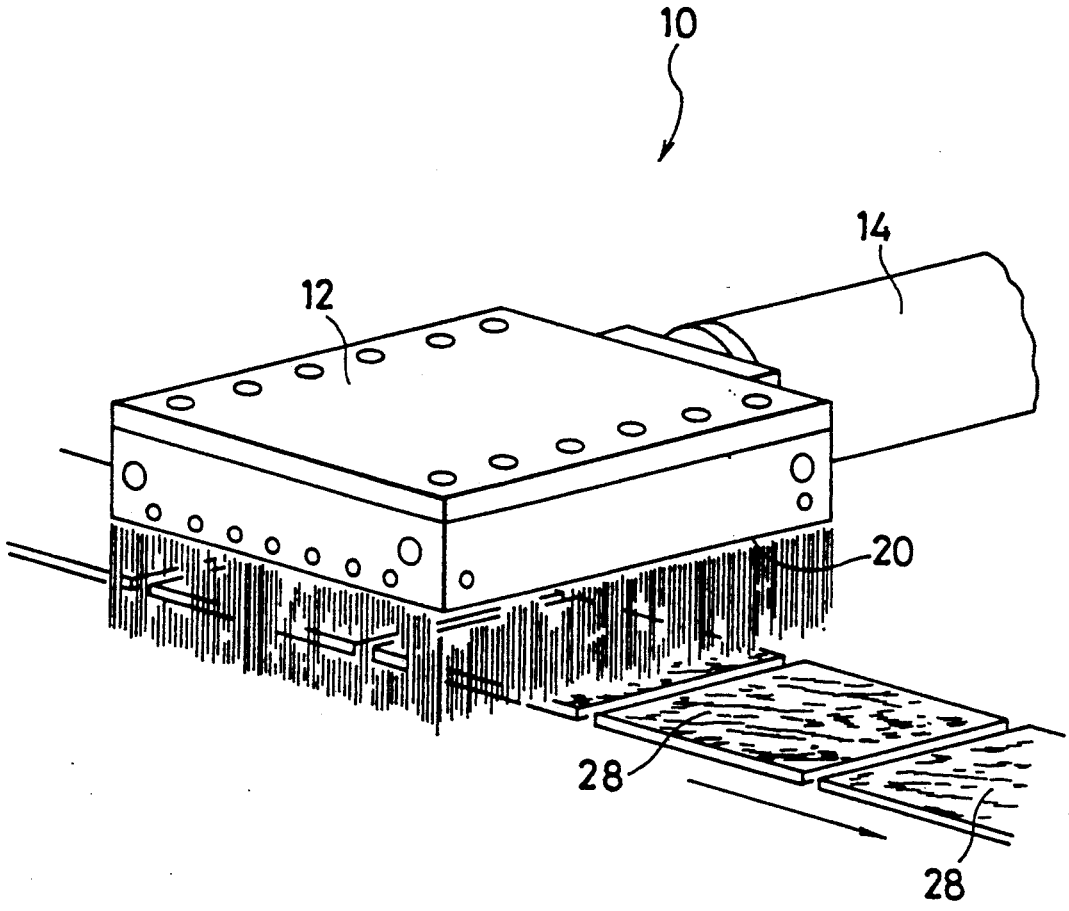
FIG. 1 is a view showing the manner in which a reduction process is carried out by a reducing burner made according to one embodiment of the present invention.

FIG. 1 shows how the burner 10 is used. Specifically, the material or ceramix tile 28 is heated to a predetermined temperature while being conveyed through the burner 10. The burner head 12 is oriented downwardly to inject a mixture of fuel and air (The air is used to promote combustion) from each injection hole 26, wherein the mixture is lean or has less fuel in it, and the fuel is partly decomposed to provide a reducing gases such as carbon monoxide and hydrogen). The reducing gas is then applied to the tile 28 so as to immediately reduce the surface of the tile 28. As a result of reduction, the tile 28 presents a deep tasteful color.

In this embodiment, flames with reducing gases, more particularly, reducing gases produced in the flame as a result of decomposition is applied from the injection holes 28 at a predetermined rate. During reduction, the material 28 is protected from an external atmosphere under the influence of the flames. Thus, the material can uniformly be reduced to provide a stable color.

A feature of this embodiment is that a number of injection holes 26 are small in diameter and are accurately arranged in the entire injection surface 20 of the burner head 12. This allows the injection holes 26 to be located as closely to the tile 28 as possible so as to minimize the effect of an external atmosphere during a reducing operation. In addition, the flames or reducing gases injected from the injection holes 26 to the outer peripheral portion of the tile 28 is identical in composition to those injected to the central portion of the tile 28. This enables uniform or beautiful color of the tile 28.

Figure 6A:
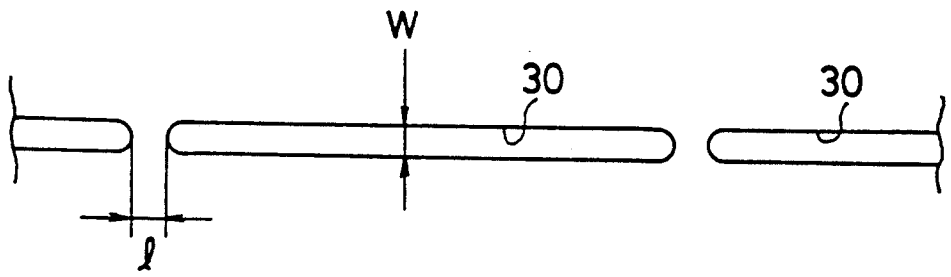
FIGS. 6A and 6B are views showing the shape and arrangement of injection holes according to another embodiment of the present invention.

The injection holes may take any forms. For example, injection holes 30 may be in the form of a slit as shown in FIG. 6A. When a number of injection slits 30 are serially arranged, then the distance λ should be less than three times of the width W of each slit 30.

Figure 6B:
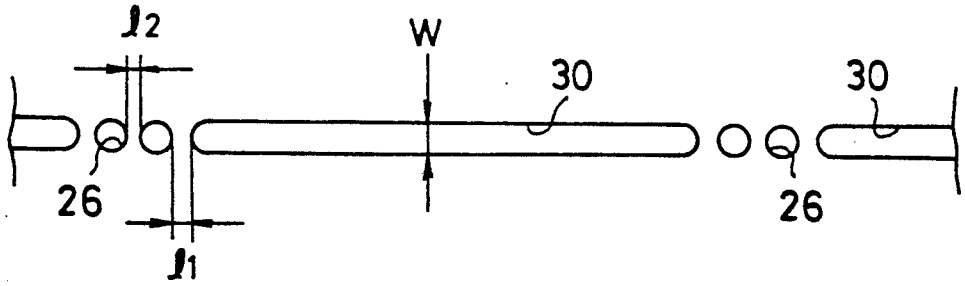

As shown in FIG. 6B, the injection holes may be a combination of injection slits 30 and circular injection holes 26. In such a case, the distance $\lambda_1$ therebetween should be less than three times of the width W of the slit 30.

While several embodiments of the present invention have been described, changes may be made in the present invention.

In the illustrated embodiment, a ceramix tile is used as a material to be fired. The present invention is applicable to other materials. Each injection hole may take any shapes other than the circular hole. The burner of the present invention may be operated in a batch manner rather than in a continuous manner. Also, the burner may be mounted within the furnace to fire and reduce materials in a simultaneous manner. Alternatively, the burner may be mounted outside of the furnace to effect reduction only. Illustratively, the reducing gases are produced as a result of decomposition. As an alternative, a large amount of coke oven gas may be used to provide carbon monoxide and hydrogen.

Figure 7A:
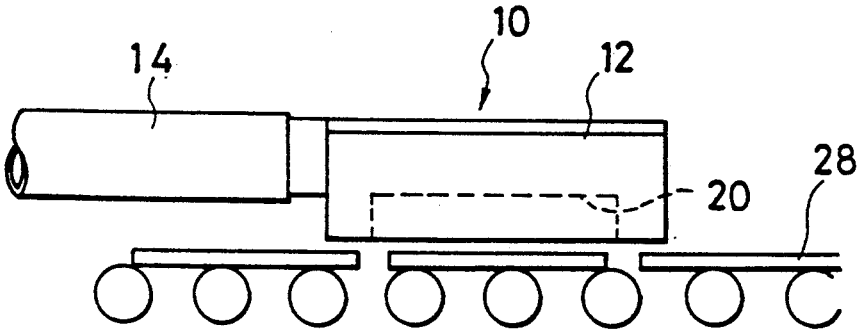
FIG. 7A is a side view showing the principal part of a burner according to another embodiment of the present invention.
Figure 7B:
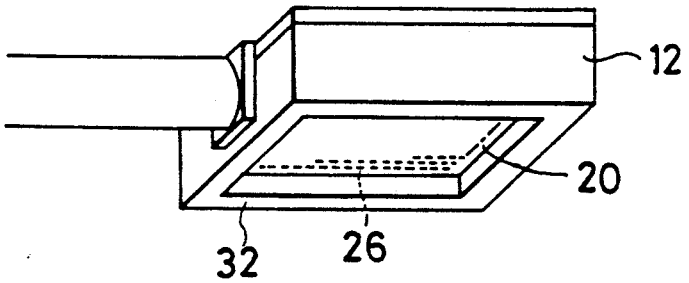
FIG. 7B is a perspective view, as seen from the bottom, showing the principal part of a burner according to a still another embodiment of the present invention.
Figure 8:
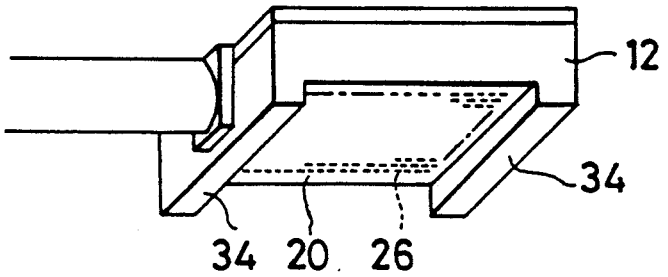
FIG. 8 is a perspective view, as seen from the bottom, showing the principal part of a burner according to a further embodiment of the present invention.

As shown in FIGS. 7 and 8, shielding walls 32 and 34 may extend from the edge of the injection surface 20 so as to wrap flame to apply a reducing gas to materials inside of the shielding walls 32 and 34. In this way, the material is less affected by an external atmosphere during a reduction operation.

Figure 9:
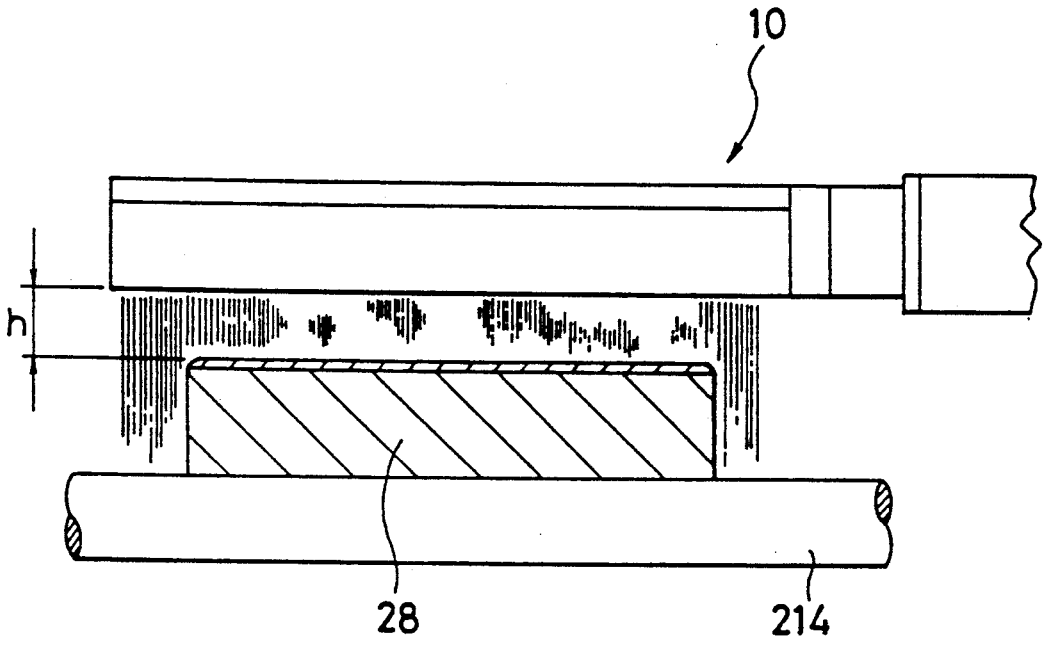
FIG. 9 is a view showing the manner in which a reduction method according to one embodiment of the present invention is carried out.

As shown in FIG. 9, the burner 10 is spaced at a distance h away from the material 28 to be fired and includes a number of burner holes of a diameter of 3 mm. A propane gas and air are used to apply a reducing flame to the surface of the material 28 immediately after the material 28 has been fired at a temperature of approximately 1200° C. FIG. 10 shows the distance between the burner and the surface of the material as well as the density of carbon monoxide.

As is clear from FIG. 10, the density of carbon monoxide is high, and the surface of the material is better reduced when the distance h is in the range of between 15 and 80 mm.

Figure 11:
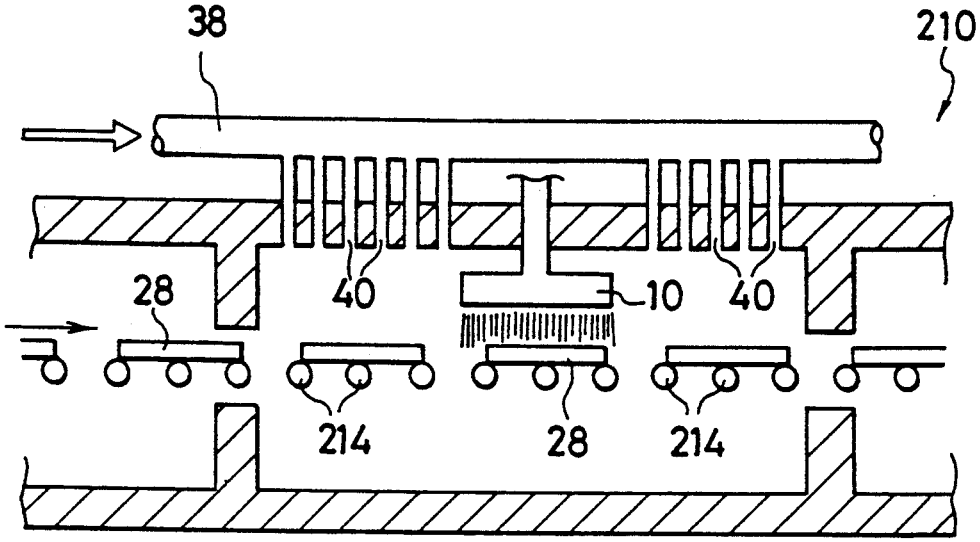
FIG. 11 is a view showing a method according to one embodiment of the present invention.
Figure 12:
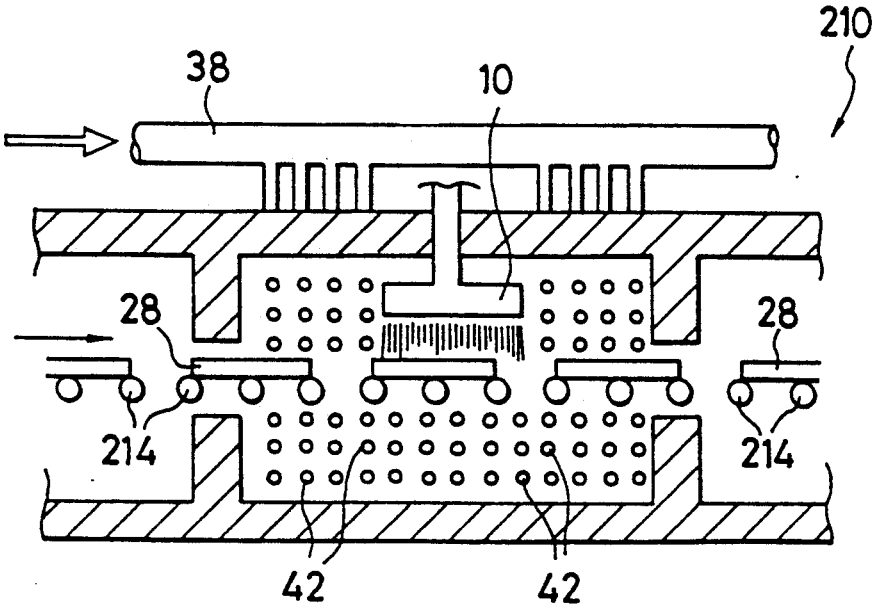
FIGS. 12 and 13 are views showing methods according to different embodiments of the present invention.
Figure 13:
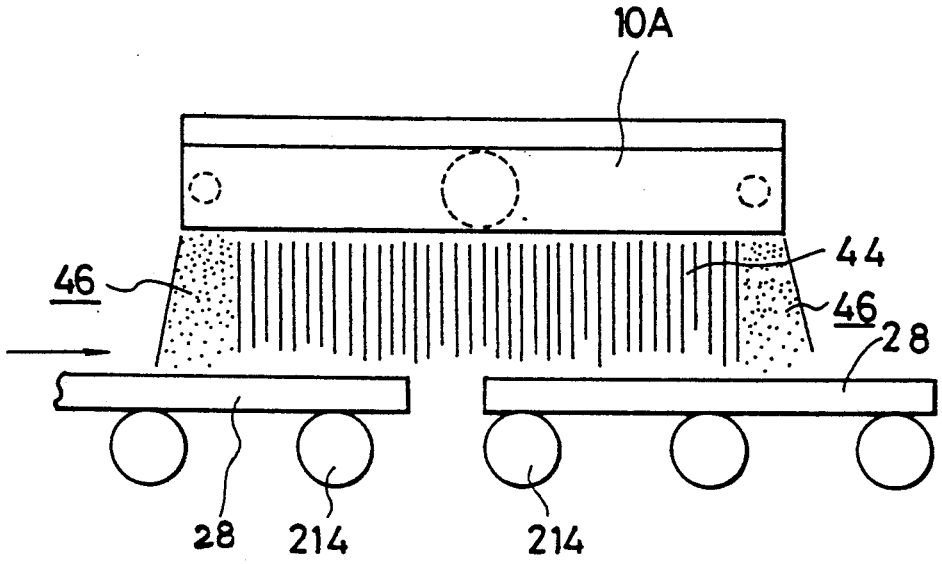

FIGS. 11 to 13 shows other preferred embodiments.

In FIG. 11, while reduction is carried out by the reducing burner 10, $N_2$ gas as a low reactive gas is applied from a conduit 38 to the interior of the furnace through a plurality of openings 40 defined in the front and rear of the reducing burner 10 so as to provide a $N_2$ gas zone.

With this furnace, a material 28 is wrapped by the reducing gas during a reducing operation. At this time, the $N_2$ gas zone eliminates gases in the previous and following operations. Accordingly, the surface of the material can be reduced under constant and stable conditions to provide a high quality product, that is, products of different colors and tones.

In FIG. 12, openings 42 are formed in the side wall of the furnace to provide a $N_2$ gas zone in the furnace. The other components are identical to those in the embodiment shown in FIG. 11 and will not be described in detail.

As shown in FIG. 13, a reducing flame 44 is supplied from a reducing burner 10A to reduce the surface of the material 28. In this embodiment, a pair of $N_2$ gas injection holes is defined in front and rear ends of the reducing burner 10A to provide $N_2$ gas zones 46 so as to eliminate an external atmosphere.

Figure 14:
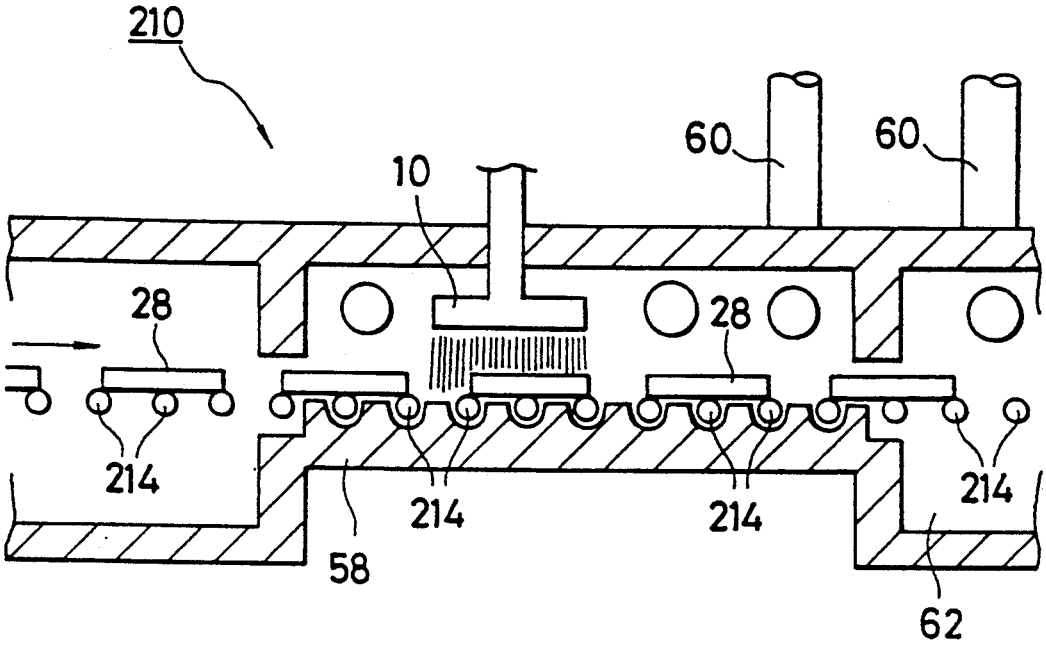
FIGS. 14 and 15 are vertical and transverse sectional views, respectively, showing the principal part of a continuous kiln according to one embodiment of the present invention.
Figure 15:
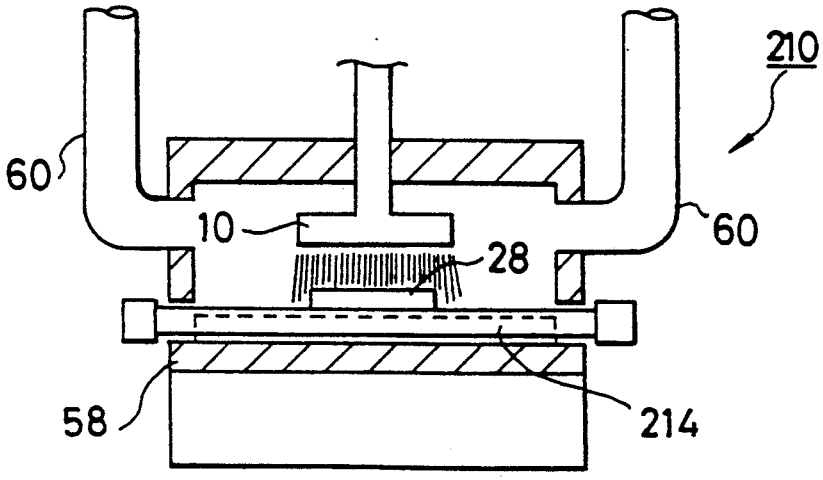

FIGS. 14 and 15 shows preferred embodiments of the present invention.

The reducing burner 10 is oriented downwards in the reduction zone rearwardly of the firing zone of the continuous kiln 210 so as to apply a reducing flame directly to the surface of the material 28 during a reducing operation. 60 is an exhaust duct.

In this embodiment, a refractory body 58 is arranged immediately below the reducing burner 10 and extends in the longitudinal direction of the continuous kiln 210 so as to prevent the reducing flame from passing downwardly between the rollers 214.

The material 28 is fired while the material 28 is conveyed from the inlet toward the outlet of the kiln 210 by the rollers 214, more specifically, after the material 28 passes through the firing zone, reduction takes place by the burner 10 in the reduction zone downstream of the firing zone.

The tile or material is then introduced into the cooling zone 62 and thereafter, discharged to an atmosphere for cooling purposes.

In this embodiment, the continuous kiln 210 includes the shielding body 58 below the rollers to prevent a reducing flame by the burner 10 from passing between the materials 28, 28 and the rollers 214. Thus, the flame in no way flares when the materials 28 pass immediately below the burner 10. Reducing conditions can also be maintained in the reduction zone. This allows the reducing flame to fully function so as to constantly reduce the materials 28 and thus, provide a reduced color as desired.

Although several embodiments of the present invention have been described, changes may be made in the present invention.

For example, a refractory plate as a refractory body may be mounted below the rollers 214. A tile may be placed on a plate during conveyance. Alternatively, the floor of the furnace may be used as a refractory body. Any other means can be used as a refractory body provided that a flame is prevented from passing downwardly between the rollers 214.

INDUSTRIAL APPLICABILITY

In the present invention, the burner is mounted in the continuous kiln to apply a reducing flame directly to a material during a reducing operation. This results in reduction of the material under stable conditions so as to continuously provide products of equal color and constant quality on a mass production basis.

We claim:

1. A continuous kiln for firing materials comprising:

a tunnel furnace having a firing zone, a reducing zone and an outlet;

a multiplicity of horizontal rollers adapted to convey materials to be fired through the furnace;

a firing burner provided in said furnace at the firing zone for firing the materials on the rollers;

a reducing burner located at the reducing zone closer to the outlet of the furnace than the firing zone in which the materials fired by said firing burner are further fired so as to apply a reducing flame to surfaces of the materials, said reducing burner including an injection surface, a multiplicity of small gas injection holes formed at the injection surface and having a diameter of 1 to 5 mm, the distance between adjacent injection holes being less than three times of the diameter of one injection hole, and a shielding wall extending downwardly from an edge of the injection surface to warp flames ejected from the injection holes to thereby shield the flames from an external atmosphere, and means mounted adjacent to the reducing burner for supplying a low reactive gas to form a low reactive gas zone adjacent to the reducing zone so as to prevent an external gas from entering into the reducing zone.

2. A continuous kiln according to claim 1, wherein said shielding wall extends downwardly from all edges of the injection surface.

3. A continuous kiln according to claim 2, wherein said low reactive gas zone is formed at front and rear sides of the reducing zone.

4. A continuous kiln according to claim 1, wherein said reducing burner includes a premixing chamber in which a gas is mixed with a fuel in gas phase to promote combustion before the fuel enters into said injection holes.

5. A continuous kiln according to claim 1, wherein the distance between said reducing burner and the material to be fired is in the range of between 15 and 80 mm.

6. A continuous kiln according to claim 1, wherein the distance between the surface of the material to be fired and a base end of the flame is three tenth to seven tenth of an entire length of the reducing flame.

7. A continuous kiln according to claim 1, wherein said low reactive gas is at least one of He, Ne Ar, $N_2$ and $CO_2$.

8. A continuous kiln according to claim 1, further including a refractory element provided at least either below the rollers or between the rollers so as to prevent the reducing flame of said reducing burner to pass between the rollers.

9. A continuous kiln for firing materials comprising:

a tunnel furnace having a firing zone, a reducing zone and an outlet;

a multiplicity of horizontal rollers adapted to convey materials to be fired through the furnace;

a firing burner provided in said furnace at the firing zone for firing the materials on the rollers;

a reducing burner located at the reducing zone closer to the outlet of the furnace than the firing zone in which the materials fired by said firing burner are further fired so as to apply a reducing flame to surfaces of the materials, said reducing burner including an injection surface, a multiplicity of small gas injection holes formed at the injection surface, at least some of the injection holes being in a form of a slit having a width of 1 to 5 mm, and a shielding wall extending downwardly from an edge of the injection surface to warp flames ejected from the injection holes to thereby shield the flames from an external atmosphere, and means mounted adjacent to the reducing burner for supplying a low reactive gas to form a low reactive gas zone adjacent to the reducing zone so as to prevent an external gas from entering into the reducing zone.

10. A continuous kiln according to claim 9, wherein said shielding wall extends downwardly from all edges of the injection surface.

11. A continuous kiln according to claim 10, wherein said low reactive gas zone is formed at front and rear sides of the reducing zone.

12. A continuous kiln according to claim 9, wherein the distance between adjacent injection holes is less than three times of the width of the injection hole in the form of a slit.

13. A continuous kiln according to claim 9, wherein said reducing burner includes a premixing chamber in which a gas is mixed with a fuel in gas phase to promote combustion before the fuel enters into said injection holes.

14. A continuous kiln according to claim 9, wherein the distance between said reducing burner and the material to be fired is in the range of between 15 and 80 mm.

15. A continuous kiln according to claim 9, wherein the distance between the surface of the material to be fired and a base end of the flame is three tenth to seven tenth of an entire length of the reducing flame.

16. A continuous kiln according to claim 9, wherein said low reactive gas is at least one of He, Ne, Ar, $N_2$ and $CO_2$.

17. A continuous kiln according to claim 9, further including a refractory element provided at least either below the rollers or between the rollers so as to prevent the reducing flame of said reducing burner to pass between the rollers.

* * * * *

UNITED STATES PATENT AND TRADEMARK OFFICE

CERTIFICATE OF CORRECTION

PATENT NO. :5,248,255

DATED :September 28, 1993

INVENTOR(S) :Toshimichi Morioka, et. al.

It is certified that error appears in the above-indentified patent and that said Letters Patent is hereby corrected as shown below:

On the Title page, item [75], inventor's name, "Yaushisa Hirano" to --Yasuhisa Hirano--.

Signed and Sealed this

Fifteenth Day of March, 1994

*Attest:*

*Attesting Officer*

BRUCE LEHMAN

*Commissioner of Patents and Trademarks*